US012565751B2

(12) United States Patent
McNeil et al.

(10) Patent No.: US 12,565,751 B2
(45) Date of Patent: Mar. 3, 2026

(54) LINER AND INFLATION BLADDER OFFSET SECUREMENT SYSTEM AND METHOD

(71) Applicant: McNeil Technologies, Inc, Graceville, FL (US)

(72) Inventors: Ronald A McNeil, Tallahassee, FL (US); Ryan A. McNeil, El Paso, TX (US)

(73) Assignee: McNeil Technologies, Inc, Graceville, FL (US)

( * ) Notice: Subject to any disclaimer, the term of this patent is extended or adjusted under 35 U.S.C. 154(b) by 118 days.

(21) Appl. No.: 18/667,134

(22) Filed: May 17, 2024

(65) Prior Publication Data

US 2024/0384494 A1 Nov. 21, 2024

Related U.S. Application Data

(60) Provisional application No. 63/503,206, filed on May 19, 2023.

(51) Int. Cl.
*E02D 29/12* (2006.01)
*E03F 7/00* (2006.01)
*F16L 55/165* (2006.01)

(52) U.S. Cl.
CPC ..... *E02D 29/128* (2013.01); *E03F 7/00* (2013.01)

(58) Field of Classification Search
CPC ..... E02D 29/128; E03F 7/00; F16L 55/165–1656; B29C 63/34
See application file for complete search history.

(56) References Cited

U.S. PATENT DOCUMENTS 3,068,561 A * 12/1962 Jones ..... B65D 90/046 52/39
5,265,981 A 11/1993 McNeil
5,490,744 A * 2/1996 McNeil ..... F16L 55/165 405/133
5,915,886 A 6/1999 McNeil
6,368,025 B1 4/2002 McNeil
6,634,828 B1 * 10/2003 Hovad ..... B29C 63/0021 264/269
7,018,691 B2 3/2006 McNeil
10,202,736 B1 * 2/2019 Plummer ..... B32B 5/022
(Continued)

*Primary Examiner* — Amber R Anderson
*Assistant Examiner* — Stacy N Lawson
(74) *Attorney, Agent, or Firm* — CALDERON SAFRAN & WRIGHT P.C.

(57) ABSTRACT

A liner assembly offset securement system for reinforcing walls of an underground sewer structure. The underground sewer structure includes a neck portion, an offset portion extending at an angle and offset from the neck portion, and a chamber portion extending downwardly from the offset portion. The offset securement system comprises a liner, an inflatable bladder disposed within the liner, a plurality of offset structure anchors, a plurality of loop units attached to the liner, and a plurality of pull straps. Each of the offset structure anchors is configured to be fixed to the underground sewer structure between offset and chamber portions thereof. Each of the pull straps has a proximal end and a distal end, the proximal end of each of the pull straps connected to one of the bladder anchors through one of the loop units of the liner and one of the offset structure anchors.

24 Claims, 6 Drawing Sheets

(56) References Cited

U.S. PATENT DOCUMENTS

| | | | | |
|---|---|---|---|---|
| 2015/0023735 | A1* | 1/2015 | Eschenbrenner | E02D 29/12 405/133 |
| 2024/0117587 | A1* | 4/2024 | Blenke | F16L 55/1656 |
| 2025/0035247 | A1* | 1/2025 | Buss | F16L 55/1656 |

* cited by examiner

Fig. 4
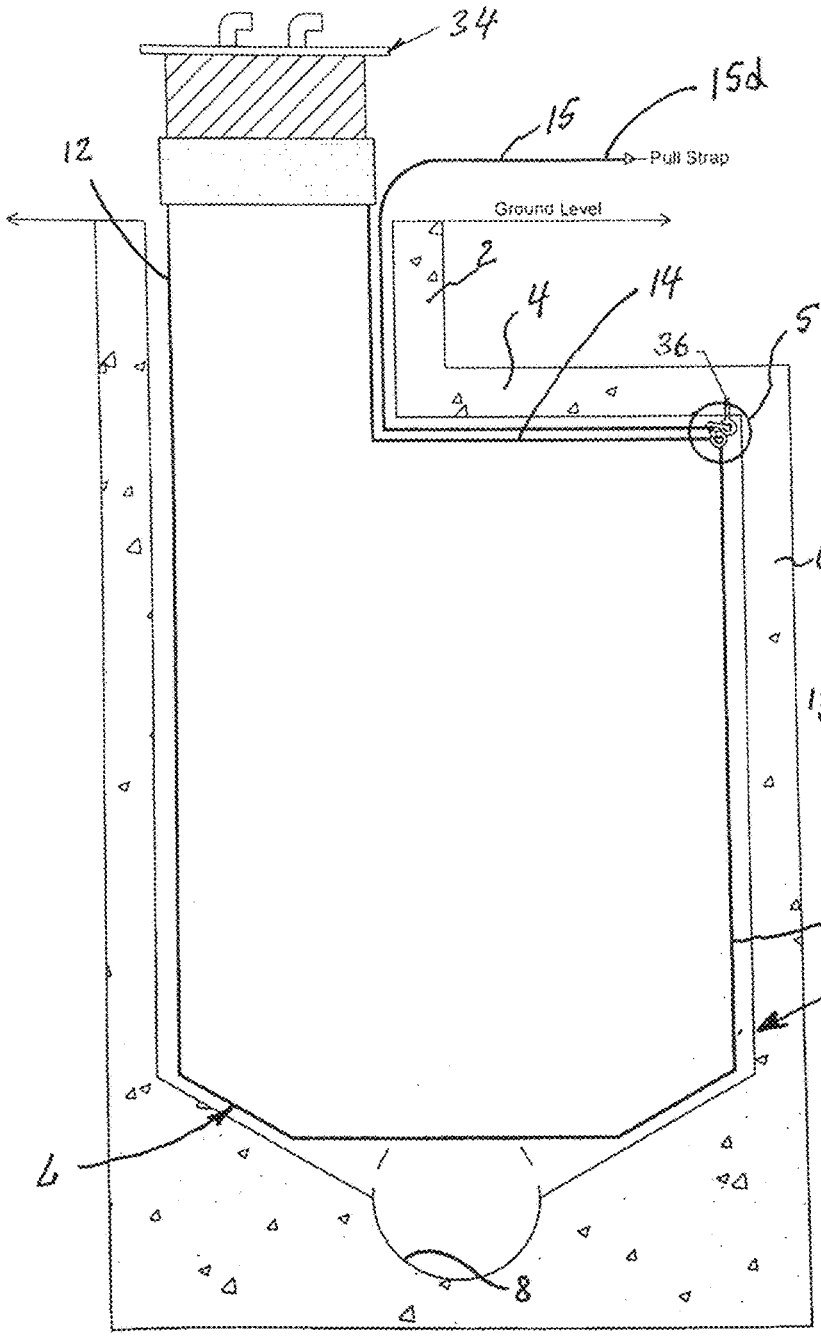
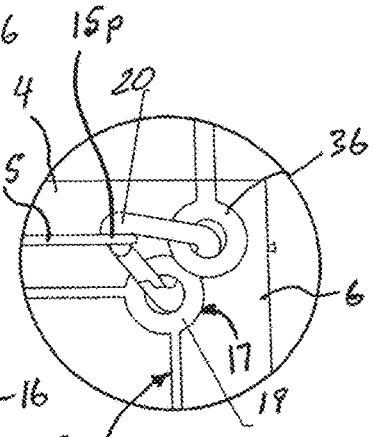
Fig. 5

Fig. 7
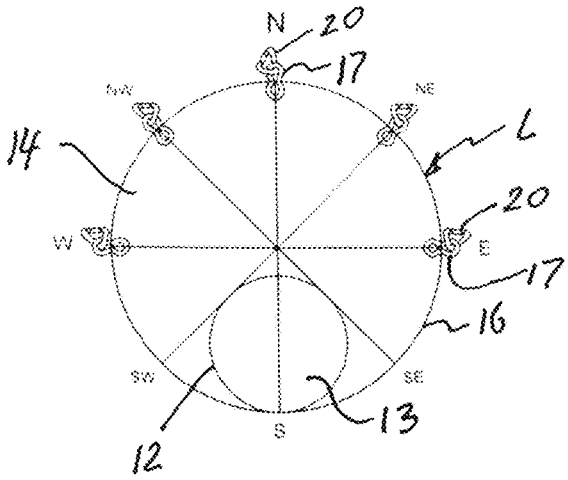
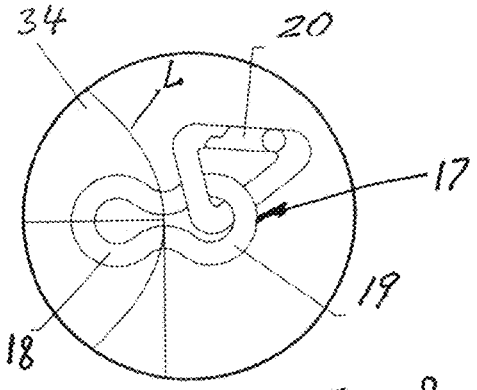
Fig. 8
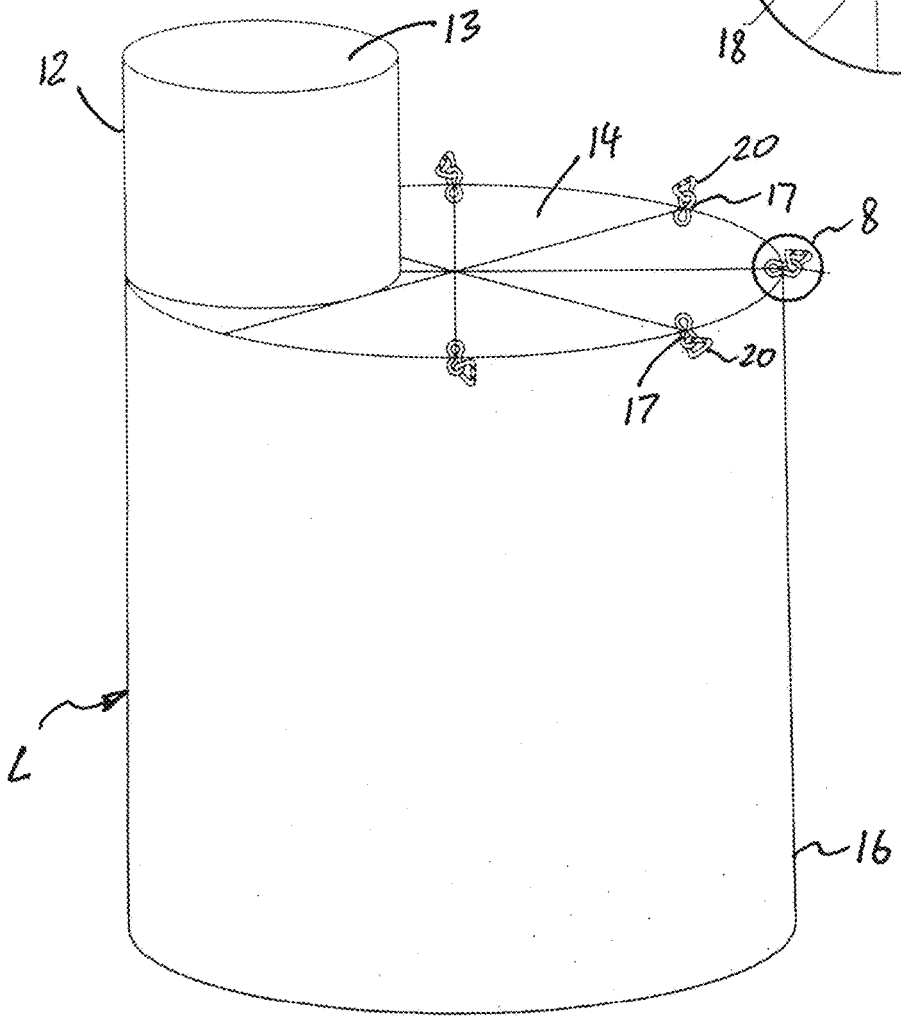
Fig. 6

Fig. 10
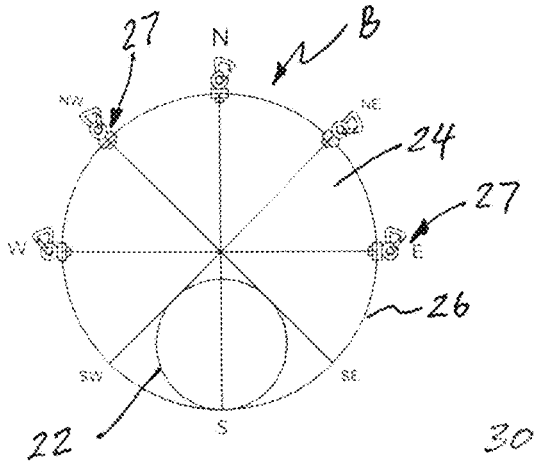
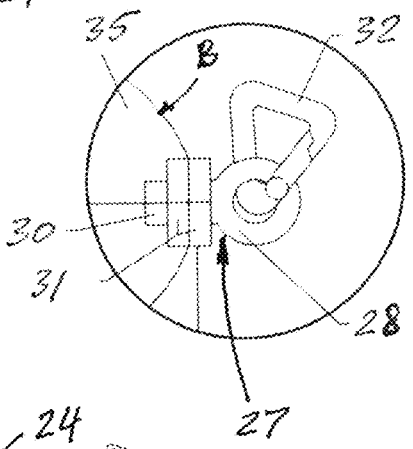
Fig. 11
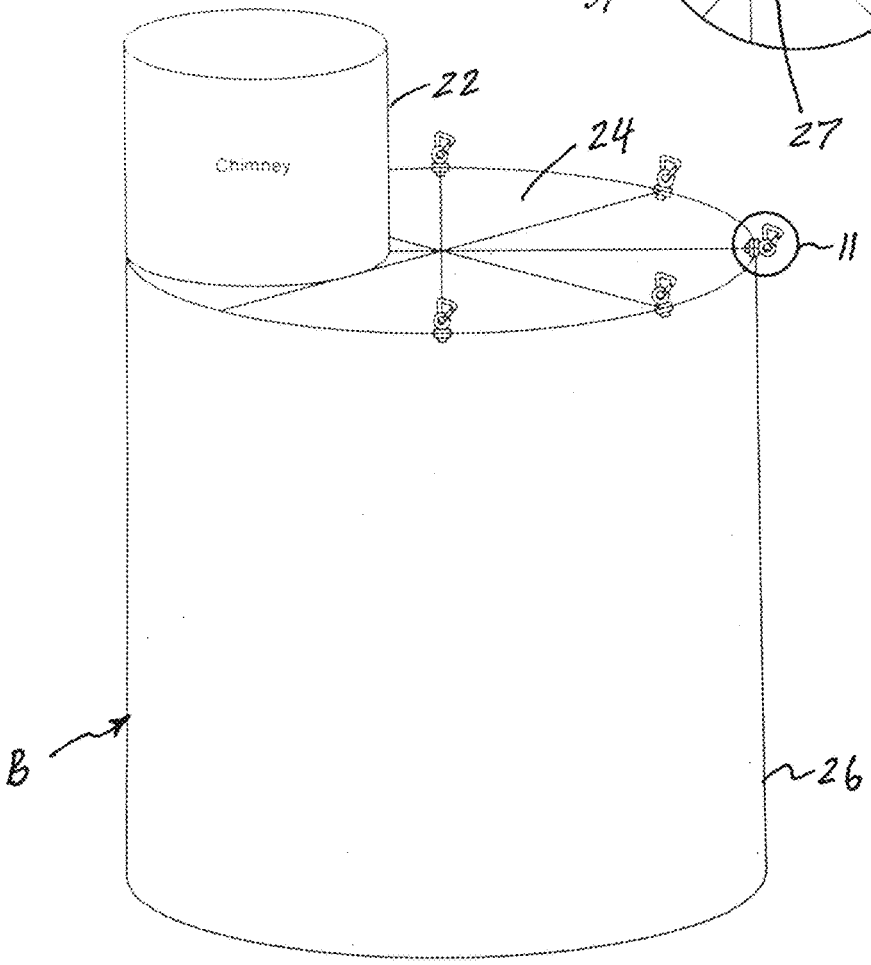
Fig. 9

Fig. 13
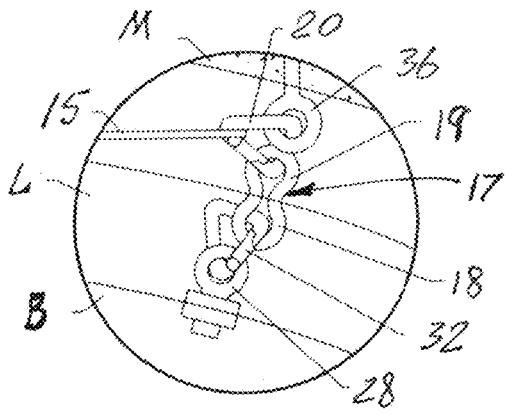
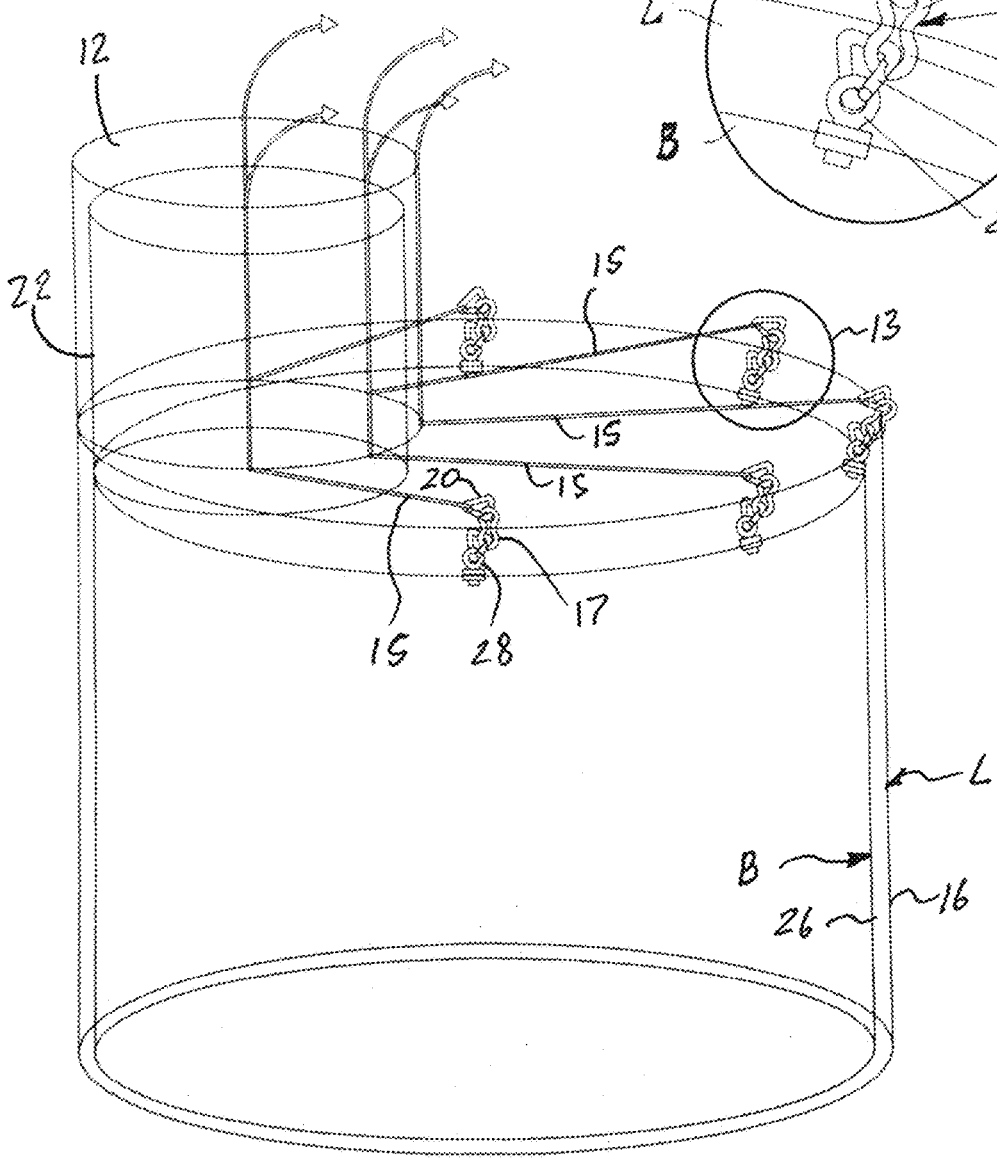
Fig. 12

LINER AND INFLATION BLADDER OFFSET SECUREMENT SYSTEM AND METHOD

CROSS-REFERENCE TO RELATED APPLICATION AND CLAIM TO PRIORITY

This application claims the benefit of U.S. Provisional Patent Application Ser. No. 63/503,206 filed May 19, 2023 by McNeil et al., which is hereby incorporated herein by reference in its entirety and to which priority is claimed.

BACKGROUND OF THE INVENTION

1. Field of the Invention

The present invention relates to a liner and inflation bladder offset securement system, such as a resin impregnated liner for rehabilitating and reinforcing an underground structure such as a manhole, or sewer and stormwater structure. More particularly, the present invention is directed to a system and method for enhancing the ability to locate and place the liner and its inflation bladder into the best configuration to eliminate hollow spots and/or tears in the liner or bladder during installation and curing of the liner system.

2. Description of the Related Art

Underground manholes and the like are frequently formed from brick, cement, and like cementitious and/or refractory materials. The manhole usually has a relatively long neck portion extending downwardly from the surface, and terminating in a lower sometimes flaring portion to which a sewer pipe communicates. The sewage flowing through the sewer pipe, over time, may damage the mortar which secures the bricks of the manhole together, or the cement with which the manhole is formed. Damage to the bricks and cement may permit ground water and subsurface water to infiltrate the manhole, with the result that the water treatment plant may become overloaded and unable to handle the amount of water which it receives during rain and other such occurrences. In that event, either untreated water is uncontrollably discharged, or the water treatment plant itself becomes unable to perform its function and needs to be taken out of service.

Replacement of a manhole is a relatively expensive undertaking, because of the need to excavate the surrounding soil and remove the bricks and other materials. In addition, the sewer itself must continue to be usable during the procedure, or else homes and businesses will be unable to flush toilets, run taps, etc. For this reason, it is desirable to rehabilitate and/or reinforce the manhole in a way which avoids a need for replacement.

U.S. Pat. No. 5,265,981, the disclosure of which is incorporated herein by reference, discloses a method and apparatus for rehabilitation of a manhole through use of a resin impregnated fiberglass liner which is inflated and cured in place while permitting the manhole to remain in service as it is being rehabilitated. That patent discloses the use of heated air to inflate the liner so that the surrounding walls of the manhole are engaged, after which the resin cures and secures the liner to the walls of the manhole. We have found that heated air can take a relatively long period to achieve sufficient resin cure. Particularly for deep manholes, the walls of the manhole and the surrounding soil act as a heat sink which tends to cool the resin, so that additional time for curing is required because of the surrounding material that also must be heated somewhat. However, locating and placing liners and their inflation bladders so as to totally conform to curvatures inside structures that have flat offsets from the manhole ring and cover and chimney to the main cylinder of the structure is very difficult and problematic.

Moreover, it is difficult to totally conform a bladder to structures that have sloped offsets in the corbel section from the bottom of the chimney section to the main cylinder of the structures, and structures that are square or rectangular in any portion to the structure whether below the base of the chimney or further down the main cylinder where the bottom of the structure expands to a square or rectangular condition. The latter often happens in order to accommodate large liquid flow pipes or a large invert channel found in major sewer or stormwater trunk lines.

The primary problem is that it is difficult to locate and place the rehabilitation liner so as to conform to those transition places within the structure. Likewise, it is difficult to have the inflation bladder conform to those same transitions from inside the liner itself. What is needed is complete support of the liner and inflation bladder in order to properly pressurize it to the host structure into every configuration. Numerous attempts have been made attempting to solve this problem in a way that is satisfactory and consistent. At least some of the reasons why this condition (i.e., that the liner does not transition to the curvatures of the host structure in those transitional area) is problematic are as follows:

1. When the inflation bladder presses into curvatures and surface irregularities inside manholes, the liner material or sewn seams of the liner may pull apart and expose bare host structure that must be repaired after the liner is cured and installed.
2. With additional stretching of the inflation bladder as it receives pressure from the inflation source, it may burst from overstretching and allow the liner to lose necessary pressure and ultimately fail; therefore, it has to somehow be replaced.
3. Besides of the inflation bladder stretching too much to reach transition areas, it may also fail because of sticky attachment to the resin saturated liner-especially during cold temperatures.
4. Any of the transition areas are subject to excessive, and thus requiring significant time and material costs additions to the installation operation. If the liner and the inflation bladder cannot easily fit into the transitional areas of the manhole as one unit, these excessive stretching problems may occur.

In view of the above, a need exists for a liner and bladder offset securement system and method including a liner and its inflation bladder to be configured to totally conform to curvatures inside structures that have flat offsets from a manhole ring and cover and chimney to a main cylinder of the structure.

SUMMARY OF THE INVENTION

A first aspect of the invention is a liner assembly offset securement system for rehabilitating and reinforcing walls of an underground structure. The underground structure includes a neck portion, an offset portion extending at an angle and offset from the neck portion, and a chamber portion extending downwardly from the offset portion. The offset securement system comprises a liner for rehabilitating and reinforcing the underground structure, an inflatable bladder disposed within the liner, a plurality of offset structure anchors, a plurality of loop units attached to the liner, and a plurality of pull straps. The liner includes a neck portion having an open top end to provide a fluid flow path, an offset portion extending at an angle and offset from the neck portion, and a chamber portion extending downwardly from the offset portion. The inflatable bladder has a neck portion, an offset portion extending at an angle and offset from the neck portion, and a chamber portion extending downwardly from the offset portion, the inflatable bladder provided with a plurality of bladder anchors attached to an outer surface of the inflatable bladder. Each of the offset structure anchors is configured to be fixed to the underground sewer structure between the offset portion and the chamber portion. Each of the pull straps has a proximal end and a distal end, the proximal end of each of the pull straps connected to one of the bladder anchors through one of the loop units of the liner and one of the offset structure anchors.

A second aspect of the invention is a method of using a liner and inflation bladder offset securement system for rehabilitating and reinforcing a sewer structure. The underground structure includes a neck portion, an offset portion extending at an angle and offset from the neck portion, and a chamber portion extending downwardly from the offset portion. The method comprises the steps of providing the liner and an inflation bladder offset securement system, positioning the inflatable bladder inside the liner, fixing a plurality of offset structure anchors to the underground sewer structure between the offset portion and the chamber portion thereof, connecting the proximal end of each of the pull straps to one of the bladder anchors through one of the loop units of the liner and one of the offset structure anchors so that the distal ends of the pull straps extend away from the neck portion of the underground structure, and pulling the distal ends of the pull straps away from the underground structure so that the liner contacts internal surfaces of the underground structure.

A third aspect of the invention is a method for rehabilitating and reinforcing an underground structure. The underground structure includes a neck portion, an offset portion extending at an angle and offset from the neck portion, and a chamber portion extending downwardly from the offset portion. The method comprises the steps of providing a liner having a neck portion, an offset portion extending at an angle and offset from the neck portion, a chamber portion extending downwardly from the offset portion, and a plurality of loop units, providing an inflatable bladder having a neck portion, an offset portion extending at an angle and offset from the neck portion, and a chamber portion extending downwardly from the offset portion. The inflatable bladder is provided with a plurality of bladder anchors attached to an outer surface of the inflatable bladder. Then, the inflatable bladder is positioned inside the liner. Next, a plurality of offset structure anchors are fixed to the underground sewer structure between the offset portion and the chamber portion thereof. Also, a plurality of pull straps are provided, and ach of the pull straps has a proximal end and a distal end. The proximal end of each of the pull straps is connected to one of the bladder anchors through one of the loop units of the liner and one of the offset structure anchors so that the distal ends of the pull straps extend away from the neck portion of the underground structure. After that, the distal ends of the pull straps are pulled away from the underground structure so that the liner contacts internal surfaces of the underground structure.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings:

FIG. 4 is a sectional view of the liner and inflation bladder offset securement system with the liner and the inflation bladder in an inflated condition;

FIG. 5 is an enlarged view of a fragment of the offset securement system shown in the circle "5" of FIG. 4;

FIG. 6 is a perspective view of the liner of the present invention in the inflated condition;

FIG. 7 is a top view of the liner of FIG. 6;

FIG. 8 is an enlarged view of a fragment of the offset securement system shown in the circle "8" of FIG. 6;

FIG. 9 is a perspective view of the inflation bladder of the present invention in the inflated condition;

FIG. 10 is a top view of the inflation bladder of FIG. 9;

FIG. 11 is an enlarged view of a fragment of the offset securement system shown in the circle "11" of FIG. 9;

FIG. 12 is a perspective view of the liner and inflation bladder offset securement system with the liner and the inflation bladder in the inflated condition;

FIG. 13 is an enlarged view of a fragment of the offset securement system shown in the circle "13" of FIG. 12;

FIG. 15 is an enlarged view of a fragment of the offset securement system shown in the circle "15" of FIG. 14; and FIG. 16 is an enlarged view of a fragment of the offset securement system shown in the circle "16" of FIG. 14.

DETAILED DESCRIPTION OF EXEMPLARY EMBODIMENTS

Figure 1:
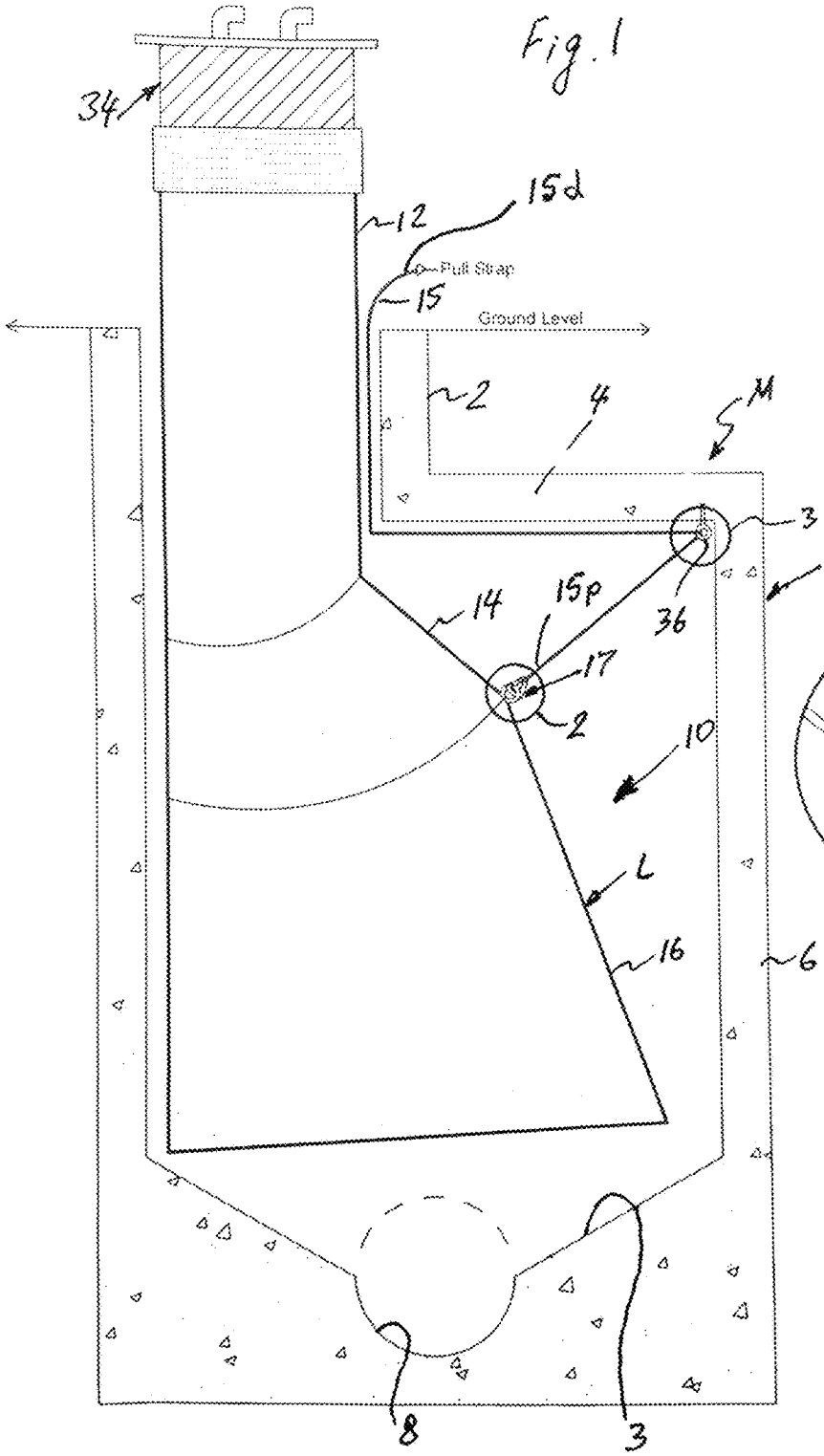
FIG. 1 is a liner and inflation bladder offset securement system according to a first exemplary embodiment of the invention with a liner and an inflation bladder in an under-inflated condition.
Figure 2:
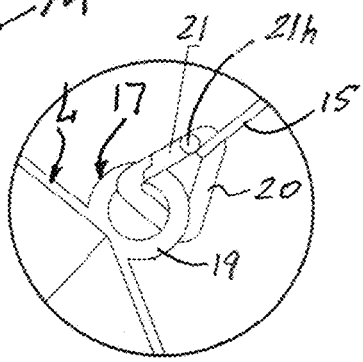
FIG. 2 is an enlarged view of a fragment of the offset securement system shown in the circle "2" of FIG. 1.
Figure 3:
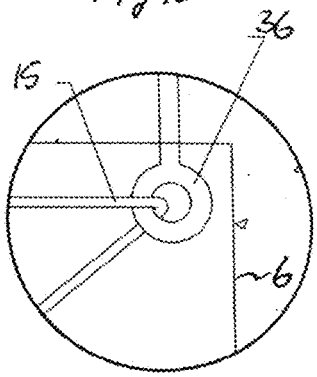
FIG. 3 is an enlarged view of a fragment of the offset securement system shown in the circle "3" of FIG. 1.

Reference will now be made in detail to the exemplary embodiments and exemplary methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and exemplary methods.

This description of exemplary embodiments is intended to be read in connection with the accompanying drawings, which are to be considered part of the entire written description. In the description, relative terms such as "horizontal," "vertical," "front," "rear," "upper", "lower", "top" and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the word "a" and "an" as used in the claims means "at least one" and the word "two" as used in the claims means "at least two".

A manhole (or like underground structure, such sewer or stormwater structure) M, as best shown in FIGS. 1 and 4, is formed from a cementitious material, such as cement or brick secured by cement, and has an offset or flaring configuration. Specifically, the manhole M includes a wall defining a top or neck portion 2 from which an offset flaring portion 4 and a chamber portion 6 downwardly extend. Typically, the neck portion 2 and the chamber portion 6 of the manhole M are cylindrical. As shown in FIGS. 1 and 4, the offset portion 4 is offset or flares from the neck portion 2 of the manhole M. Inlets (not shown) communicate with the chamber portion 6 to permit water to flow to the manhole M. As is well known in the art, an invert pipe (or sewer line) 8 is formed in floor 3 of the manhole M and permits water and waste materials flowing into manhole M through inlets (not shown) to be communicated to a water treatment facility (not shown) for treatment. In addition, the invert pipe 8 is usually also in communication with other manholes, so that sewage flows from one manhole M to the next until ultimately reaching the treatment facility.

FIGS. 1 and 4 depict a liner and inflation bladder offset securement system 10 according to a first embodiment of the present invention, which is used for rehabilitating and reinforcing the manhole M in the event any of the neck portion 2, the offset portion 4 and the chamber portion 6 have deteriorated. The liner and inflation bladder offset securement system 10 comprises a liner L and a bladder B disposed inside the liner L. The liner L together with the bladder B disposed inside the liner L define a liner assembly. According to the present invention, the liner L is a resin impregnated fiberglass liner which is inflated and cured in place while permitting the manhole M to remain in service as it is being rehabilitated. The liner L, as best shown in FIGS. 1, 4, 6 and 12, has an offset or flaring configuration and an outer wall defining a neck portion 12, an offset portion 14 extending at an angle and offset from the neck portion 12, and a chamber portion 16 extending downwardly from the offset portion 14. The neck portion 12 and the chamber portion 16 typically are cylindrical in shape. As shown in FIGS. 1, 4, 6, 7, 9, 10 and 12, the offset portion 14 is offset from the neck portion 12 of the of the liner L. The liner L is similar (but not identical) to the support assembly M as described in the U.S. Pat. No. 5,265,981, the disclosure of which is incorporated herein by reference. According to the exemplary embodiment, the liner is formed of multiple juxtaposed plies, such as first and third plies formed from a woven structural fabric, such as a fiberglass, and the second ply disposed between the first and third plies and formed from a membrane impermeable to fluids. The first and third plies are impregnated with an epoxy resin system. The liner has an open top end 13 (best shown in FIGS. 6 and 7) to provide a fluid flow path.

The liner L includes with a plurality (preferably 5) of nylon loop units 17 at multiple key locations located about the offset section of the flat top manhole liner. The loop units 17 are provided on the liner L in locations adjacent to the offset portion 14 or between the offset portion 14 and the chamber portion 16 of the liner L, as best shown in FIGS. 1, 4, 6, 7, 9, 10 and 12. Each of the loop units 17 is made of nylon, such as a nylon web, and includes an inside loop 18 disposed inside the liner L and an outside loop 19 disposed outside the liner L. An outside carabiner 20 is mounted to the outside loop 19. Each of the loop units 17 is formed with or preferably pre-sewn to a reinforced sewn seam 34 of the liner L at a location disposed around the offset portion 14 of the flat top manhole liner L, as best illustrated in FIGS. 6-8. Thus, the loop units 17 are attached to the liner L and define multiple liner anchor points at both inside and outside of the liner L.

The inflatable bladder B, as best shown in FIGS. 1, 4, 6 and 9, has an outer wall defining a neck portion 22 from which an offset portion 24 and a chamber portion 26 extend. The bladder B is manufactured to have a plurality of bladder anchors 27, such as metal bladder anchors, provided on an outer surface of the bladder B in locations corresponding to the loop units 17 on the liner L. The number of the bladder anchors 27 depends on the general size of the liner L, and the required offset weight of the bladder B expected to be supported by the bladder anchors 27. Each of the bladder anchors 27 includes a bladder eyelet 28 secured to a reinforced sewn seam 35 of the bladder B by a nut 30 and a washer 31 at multiple locations located around the flat offset portion 24 of the inflatable bladder B, as best shown in FIGS. 9-11. The bladder eyelets 28 allow for a set of inside carabiners 32 to be installed on the outside of the bladder B and then clipped inside the liner L when the installation process is underway. The inside carabiners 32 are smaller than the outside carabiners 20 and hold the weight of the liner. They are relatively small and strong enough to hold the liner weight. Specifically, the inside carabiners 32 on the outside of the inflatable bladder B are clipped to the inside loop 18 disposed inside the liner L, as best shown in FIGS. 11-13. The inside carabiners 32 are structurally similar to the outside carabiners 20, and has a pivotable pinned gate 33. Those skilled in the art know that a carabiner is an object for attaching or connecting two things, for example by a climber for attaching a rope to a belt. The carabiner typically is oval or like a letter D in shape, with a part that opens and closes.

The liner and inflation bladder offset securement system 10 further comprise a plurality of offset structure anchors, each in the form of an eyebolt anchor 36 fixed (i.e., non-moveably attached) to the sewer structure M adjacent to the offset portion 4 or between the offset portion 4 and the chamber portion 6 thereof (as best shown in FIGS. 1 and 4). A plurality of nylon pull straps 15 run through the metal eyebolt anchors 36 that are installed in locations complementary to locations of the pre-sewn loop units 17 on the liner L and the outside carabiners 20. In other words, the loop units 17 are provided on the liner L in location corresponding to the structure anchors 36 fixed to the sewer structure M. As shown in FIGS. 1-5, the structure anchors 36 are disposed inside of the sewer structure M, and fixed to or adjacent to the offset portion 4 of the sewer structure M, preferably at a corner between the offset portion 4 and the chamber portion 6 of the sewer structure M. Each of the pull straps 15 has a proximal end 15*p* and a distal end 15*d*. The proximal end 15*p* of each of the pull straps 15 is connected to the outside loop 19 of one of the loop units 17 of the liner L, while the distal end 15*d* thereof extends away from the neck portion 2 of the underground structure M, as best shown in FIGS. 1 and 4. Such an arrangement of the pull straps 15 allows the installer to pull the pull straps 15, resulting in the offset portion 14 of the liner L being pulled over and up into the corners of the sewer structure M. Subsequently, the bladder B, anchored inside of the liner L in the same location, is pulled into the corner.

As illustrated in FIGS. 6 and 12, the outside loops 19 on the liner L receive a set of outside carabiners 20, one for each location. As the outside carabiners 20 are pulled, the pre-sewn loop units 17 on the liner L conform the liner L and the bladder B to internal surfaces of the offset portion 4 and the chamber portion 6 of the sewer structure M. In other words, the interconnected liner L and inflatable bladder B, i.e., the inflatable bladder B clipped inside the liner L, are clipped to the structure anchors 36 inside the sewer structure M. The outside carabiners 20 are pulled through the structure anchors 36 and clipped through, thus allowing the weight of the liner L and bladder B to be supported.

The liner L and the bladder B are attached to a canister 34 to hold the liner L and the bladder B in proper position for installation and cure. The canister 34 has a connection for the attachment of an air hose from a pump for inflation of the bladder B. The air pumped to the inflatable bladder B pressurizes the liner L into place in the manhole M. A pressure relief valve is provided to control the pressure. The canister 34 also has a connection for the attachment of a steam hose, which provides steam heat to quickly cure the resin-impregnated liner L.

Each of the outside carabiners 20 that is clipped onto the outside loop 19 of the liner L is pulled by a small end of the outside carabiner 20 (i.e., the side of the outside carabiner 20 with a pinned gate hinge 21*h* of a pinned gate 21, as shown being pulled in FIGS. 1, 2, 4 and 5), which is specifically chosen to be of a size capable to pass through the metal eyebolt anchor 36 on the host structure M, as best shown in FIG. 5.

Forces acting on the outside carabiner 20 (including gravity, the pulling force of the installer above and resistance of the structure anchors 36) cause the outside carabiners 20 to clip themselves into position. Clipping occurs because the large end of the outside carabiner 20 cannot pass through the structure anchor 36, and due to the triangular shape of the outside carabiner 20 in the pulled direction, cannot help but force the pinned gate 21 of the outside carabiner 20 open and cause the outside carabiner 20 to self-attach to the structure anchor 36. The carabiners 20, 32 are triangular in shape. As the point of the triangle is pulled through the ring, the clip self-attaches because the back end thereof cannot pass through the ring. Thus, the system 10 of the present invention allows the bladder B and the liner L to be easily pulled into the correct position and anchored inside the host structure M, into what is otherwise a nearly impossible position to reach during installation. The full weight of the offset portion 14 of the liner L and the offset portion 24 of the bladder B are then supported by the multiple structure anchors 36, allowing the installer to easily continue with the installation process, knowing that the liner L has been successfully secured into position.

A method for rehabilitating and reinforcing the underground structure M according to the present invention follows. First, the inflatable bladder B is positioned inside the liner L. Also, the plurality of offset structure anchors 36 are fixed to the underground sewer structure M between the offset portion 14 and the chamber portion 16 thereof. Then, the inside loop 18 of one of the loop units 17 of the liner L is connected to the bladder eyelet 28 of one of the bladder anchors 27 of the inflation bladder B by the inside carabiner 32. Next, the proximal end 15*p* of each of the pull straps 15 is connected to the outside carabiner 20 attached to the outside loop 19 of one of the loop units 17 of the liner L. Then, each of the pull straps 15 is extended through one of the offset structure anchors 36 so that the distal ends 15*d* of the pull straps 15 extend away from the neck portion 2 of the underground structure M. In other words, the proximal end 15*p* of each of the pull straps 15 is connected to one of the bladder anchors 27 through one of the loop units 17 of the liner L, and the distal ends 15*d* of the pull straps 15 extend away from the neck portion 2 of the underground structure M through one of the offset structure anchors 36. After that, the distal ends 15*d* of the pull straps 15 are pulled (manually or using a servo mechanism) away from the underground structure M so that the liner L contacts internal surfaces of the underground structure M. Immediately before, simultaneously with or immediately after the step of pulling the distal ends 15*d* of the pull straps 15, the bladder B is inflated with a heated fluid so that the liner L firmly contacts internal surfaces of the underground structure M.

Figure 14:
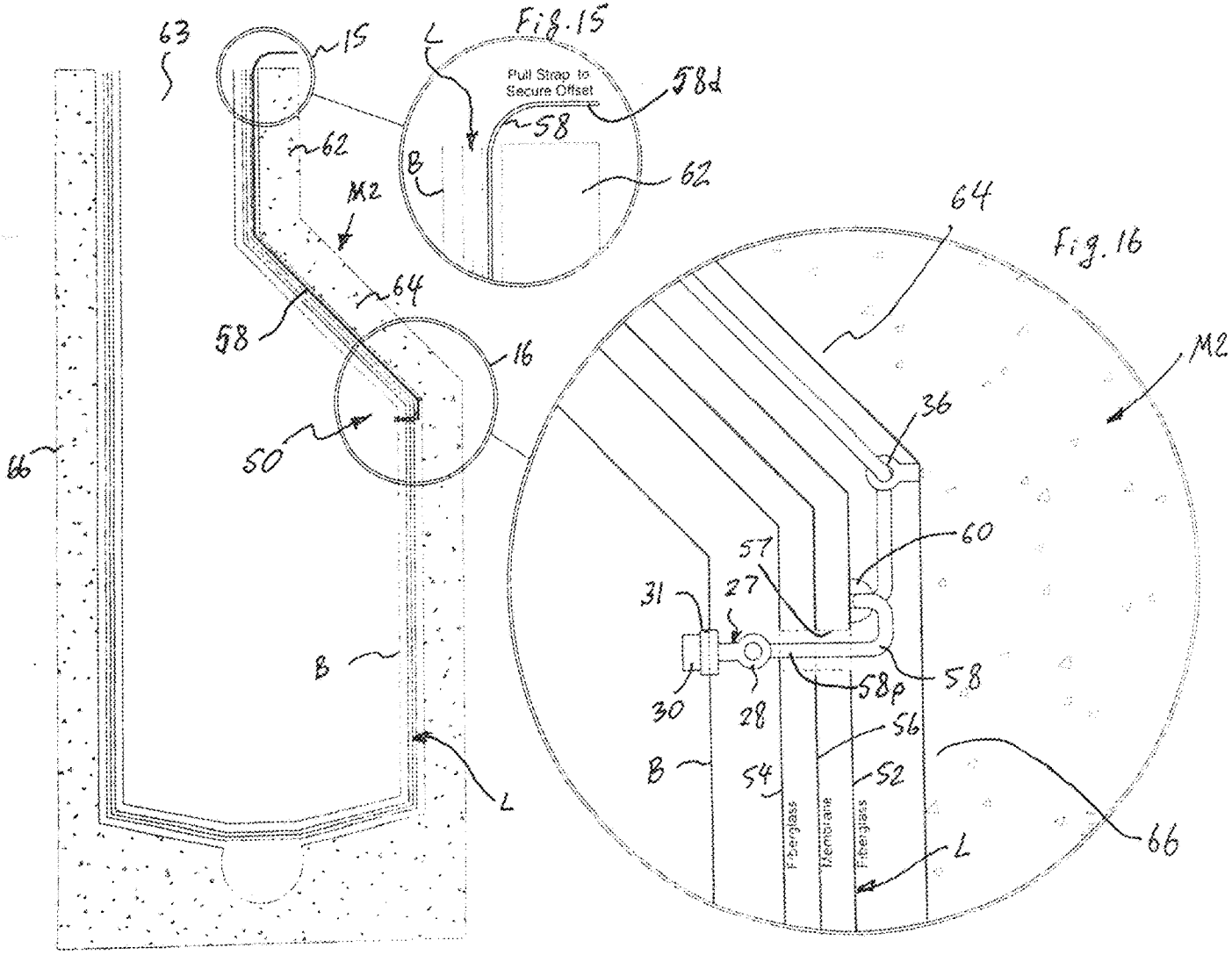
FIG. 14 is a sectional view of the liner and inflation bladder offset securement system according to a second exemplary embodiment of the present invention with the liner and the inflation bladder in the inflated condition.

FIGS. 14-16 depict a liner and inflation bladder offset securement system 50 according to a second exemplary embodiment, which is also used for rehabilitating and reinforcing an underground structure M2 after any of a neck portion 62, an offset portion 64 and a chamber portion 66 have deteriorated. According to the second embodiment, the neck portion 62 and the chamber portion 66 are at least partially cylindrical in shape. The underground structure M2, such as a manhole or any sewer and stormwater structure, as best shown in FIGS. 14-16, is formed from a cementitious material and/or brick and cement and has a wall defining a top or neck portion 62, from which an inclined offset or flaring portion 64 and a chamber portion 66 extend. Inlets (not shown) communicate with the chamber portion 66 to permit water to flow to the manhole M2.

According to the second embodiment, the liner L is made of a fabric, usually fiberglass and felt, sewn 2-4 inches down from transition points of a sewer structure M2. The liner L is formed of multiple juxtaposed plies 52, 54 and 56, respectively. First and third plies 52 and 54 are formed from a woven structural fabric, such as a fiberglass, and a second ply 56 is disposed between the first and third plies 52 and 54. The second ply 56 is formed from a membrane impermeable to fluids, such as sewage liquid. The first and third plies 52 and 54 typically are impregnated with an epoxy resin system. The liner L has an open top end 63 to provide a fluid inlet flow path. The liner L is interrupted to form a small through-opening or slit 57, preferably one inch maximum, (best shown in FIG. 16). Back tack (i.e., sewing back and forth to reinforce) on each side of the small skip in the sewing makes the slit strong. The liner is a sewn structure and has at least a large seam. Openings in the seam may be reinforced with stitching to strengthen the seam around the openings both before and after the opening. A pull rope 58 is installed and hung from both sides long enough to retrieve and securely tie each end thereof to its final attachment. Each of the pull straps 58 has a proximal end 58*p* and a distal end 58*d*. The proximal end 58*p* of each of the pull straps 58 is connected to the bladder eyelet 28 of one of the bladder anchors 27 of the inflation bladder B, while the distal end 58*d* extends away from the neck portion 62 of the underground structure M2, as best shown in FIGS. 14-16. The bladder anchor 27 is tied onto the proximal end 58*p* of the pull rope 58 that is pulled through the slit 57 in the liner L, then the pull rope 58 extends through an outer loop 60 provided on the outside of the liner L adjacent to the slit 57, securing the bladder B in place. A knot is tied or otherwise secured onto each end of the pull ropes 58 so they will not be accidentally pulled completely out of place as the liner fabric is saturated with resin. Tieing the knot on each end of the pull ropes 58 will allow the pull rope 58 to be pulled back and forth through the liner L material, but not with an opening large enough to expose the host structure M. The liner L fabric preferably has a 1" to 2" seam allowance that easily overlaps the slit 57 in the seam portion of the liner L fabric.

Once the liner L is fully inflated and pressurized and the pull rope 58 is disposed approximately the same distance down from the same transition areas on the inflation bladder B, a securing device, such as a bladder anchor, metal eyebolt with washers and nuts, is attached to the bladder B with a suitable method. Preferably, the metal bladder eyelet 28 is attached to the inflation bladder B with the nut 30 on each side of fender washer 31 through a heat-sealed reinforcement area of the inflation bladder B proximate the bladder anchor area. The pull rope 58 is tied to the bladder eyelet 28 of the inflation bladder B. Once the liner L is saturated with resin and the inflation bladder B is put in place, the bladder B (i.e., the bladder eyelet 28 on the inflation bladder B) is attached to the pull rope 58 and pulled into the correct position inside the liner L. Once that is completed, the pull rope 58 is secured on the outside of the liner L, such as to the outer loop 60 of the liner L. In this way, the inflation bladder B is fully attached to the liner L, and now both may be placed into position inside the host structure M2 into a place where the liner L can conform to the contours of the transition area inside the host structure M2. Putting the loops on the inflation bladder B and the liner L 2-4 inches down from these transition areas within the host structure allows excess material to be available to attach to the host structure without the risks of tearing and exposing the host structure.

The inflation bladder B and the liner L are now attached together, and an additional rope or strap is attached and threaded through a metal eyelet anchor located in the point of transition on the host structure. This strap continues to the top and outside of the host structure. The inflation bladder B are attached to the liner L, and the pull straps 58 that are attached to the bladder B and the liner L are pulled through the eyebolt anchors 36. In other words, the pull straps run into the sewer structure and through the structure anchor eyebolts in the ceiling. The liner and bladder are thus pulled together until the eyebolt locations are reached. Subsequently, the liner L will be fully engaged into every curvature of the host structure M2. The liner L and its inflation bladder B are lifted together as one unit. This ensures that there are no voids behind the liner L, tears on the liner material exposing the host structure, or ruptured inflation bladders.

The bladder anchors 27, the outer loop 60 of the liner L, and the structure anchors 36 according to the second embodiment are installed in the same locations as in the method according to the first embodiment. The pull straps 58 are tied to the bladder anchors 27, passed through the liner L at the small openings 62, and secured to the outer loops to secure the bladder in the correct position. Each of the bladder anchors 27 is tied onto one of the pulling ropes 58 that is pulled through a corresponding one of the slits 57 in the liner L, then it is tied to one of the outer loops 60 on the liner L, securing the bladder B in place. After saturation of the liner L with resin, the pulling ropes 58 are pulled through the structure anchors 36 until the liner L reaches an upper corner of the underground structure M2, i.e., a corner between the offset portion 64 and the chamber portion 66 of the manhole M2. This secures the liner L and bladder B in the correct position.

Therefore, the securement system 50 and method according to the second embodiment achieve the same results as the securement system 10 and method according to the first embodiment. The liner and inflation bladder offset securement systems 10 or 50 according to the present invention, although seemingly simple, completely solve a significant problem and eliminates much of the cost and performance pressure by installers.

The foregoing description of the exemplary embodiment of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A liner assembly offset securement system for rehabilitating and reinforcing walls of an underground structure, the underground structure including a neck portion, an offset portion extending at an angle and offset from the neck portion, and a chamber portion extending downwardly from the offset portion, the offset securement system comprising:

a liner for rehabilitating and reinforcing the underground structure, the liner including a neck portion with an open top end, an offset portion extending at an angle and offset from the neck portion, and a chamber portion extending downwardly from the offset portion;

an inflatable bladder disposed within the liner, the inflatable bladder having a neck portion, an offset portion extending from and offset from the neck portion, and a chamber portion extending downwardly from the offset portion, the inflatable bladder including a plurality of bladder anchors attached to an outer surface of the inflatable bladder;

a plurality of offset structure anchors, each of the offset structure anchors configured to be fixed to the underground structure between the offset portion and the chamber portion;

a plurality of loop units attached to the liner; and, a plurality of pull straps, each of the pull straps having a proximal end and a distal end, the proximal end of each of the pull straps connected to one of the bladder anchors through one of the loop units of the liner and one of the offset structure anchors.

2. The offset securement system as defined in claim 1, wherein each of the bladder anchors is a bladder eyelet.

3. The offset securement system as defined in claim 1, wherein the plurality of loop units are attached to the liner at multiple locations adjacent to the offset portion of the liner.

4. The offset securement system as defined in claim 1, wherein each of the offset structure anchors is a structure eyebolt anchor.

5. The offset securement system as defined in claim 1, wherein the plurality of loop units are attached to the liner at multiple locations located around the offset portion of the liner.

6. The offset securement system as defined in claim 5, wherein the plurality of bladder anchors are attached to the inflatable bladder at multiple locations located around the offset portion of the inflatable bladder.

7. The offset securement system as defined in claim 6, wherein the bladder anchors are installed in locations corresponding to the loop units on the liner.

8. The offset securement system as defined in claim 1, wherein each of the loop units includes an inside loop disposed inside the liner and an outside loop disposed outside the liner.

9. The offset securement system as defined in claim 8, wherein each of the bladder anchors is connected to the inside loop of one of the loop units of the liner, and wherein the outer loop of one of the loop units of the liner is connected to the proximal end of one of the pull straps.

10. The offset securement system as defined in claim 9, wherein each of the bladder anchors is connected to the inside loop of one of the loop units of the liner by one of a plurality of inside carabiners.

11. The offset securement system as defined in claim 10, wherein the outer loop of each of the loop units of the liner is connected to the proximal end of one of the pull straps through one of a plurality of outside carabiners.

12. The offset securement system as defined in claim 1, wherein each of the pull straps is configured to be supported by one of the offset structure anchors.

13. The offset securement system as defined in claim 1, wherein each of the loop units includes only an outside loop disposed outside the liner.

14. The offset securement system as defined in claim 13, wherein the liner is provided with a plurality of slits therethrough, and wherein each of the slits is adjacent to one of the outside loops of the liner.

15. The offset securement system as defined in claim 14, wherein each of the pull straps is configured to extend through one of the structure anchors and corresponding one of the outside loops of the liner, and wherein the proximal end of each of the pull straps is configured to be secured directly to one of the bladder anchors.

16. The offset securement system as defined in claim 1, further comprising a canister provided to hold the liner and the bladder in proper position for installation and cure.

17. A method of using a liner and inflatable bladder offset securement system for rehabilitating and reinforcing an underground structure, the underground structure including a neck portion, an offset portion extending at an angle and offset from the neck portion, and a chamber portion extending downwardly from the offset portion, the method comprising the steps of:

providing the liner assembly offset securement system as defined in claim 1;

positioning the inflatable bladder inside the liner;

fixing the plurality of offset structure anchors to the underground structure between the offset portion and the chamber portion thereof;

connecting the proximal end of each of the pull straps to one of the bladder anchors through one of the loop units of the liner and one of the offset structure anchors so that the distal ends of the pull straps extend away from the neck portion of the underground structure; and pulling the distal ends of the pull straps away from the underground structure so that the liner contacts internal surfaces of the underground structure.

18. The method as defined in claim 17, wherein each of the bladder anchors is connected to an inside loop of one of the loop units of the liner by one of a plurality of inside carabiners.

19. The method as defined in claim 18, wherein an outer loop of each of the loop units of the liner is connected to the proximal end of one of the pull straps through one of a plurality of outside carabiners.

20. A reinforced manhole, comprising:

a cementitious structure having a neck portion with an open top end, an offset portion extending at an angle and offset from the neck portion, and a chamber portion extending downwardly from the offset portion, a bottom, and at least one inlet pipe and one outlet pipe proximate the bottom;

a liner including a neck portion with an open top end, an offset portion extending at an angle and offset from the neck portion, and a chamber portion extending downwardly from the offset portion, the liner juxtaposed to the cementitious structure and bonded thereto with resin;

an inflatable bladder disposed within the liner, the inflatable bladder having a neck portion, an offset portion extending from and offset from the neck portion, and a chamber portion extending downwardly from the offset portion, the inflatable bladder including a plurality of bladder anchors attached to an outer surface of the inflatable bladder;

a plurality of offset structure anchors secured in the cementitious structure between the offset portion and the chamber portion;

a plurality of loop units attached to the liner; and, a plurality of pull straps, each of the pull straps having a proximal end and a distal end, the proximal end of each of the pull straps connected to one of the bladder anchors through one of the loop units of the liner and one of the offset structure anchors.

21. A method for rehabilitating and reinforcing an underground structure, the underground structure including a neck portion, an offset portion extending at an angle and offset from the neck portion, and a chamber portion extending downwardly from the offset portion, the method comprising the steps of:

providing a liner having a neck portion, an offset portion extending at an angle and offset from the neck portion, a chamber portion extending downwardly from the offset portion, and a plurality of loop units;

providing an inflatable bladder having a neck portion, an offset portion extending at an angle and offset from the neck portion, and a chamber portion extending downwardly from the offset portion, the inflatable bladder provided with a plurality of bladder anchors attached to an outer surface of the inflatable bladder;

positioning the inflatable bladder inside the liner;

fixing a plurality of offset structure anchors to the underground structure between the offset portion and the chamber portion thereof;

providing a plurality of pull straps, each of the pull straps having a proximal end and a distal end;

connecting the proximal end of each of the pull straps to one of the bladder anchors through one of the loop units of the liner and one of the offset structure anchors so that the distal ends of the pull straps extend away from the neck portion of the underground structure; and pulling the distal ends of the pull straps away from the underground structure so that the liner contacts internal surfaces of the underground structure.

22. The method as defined in claim 21, further comprising the step of inflating the bladder with a heated fluid so that the liner contacts the internal surfaces of the underground structure immediately before, simultaneously with or immediately after the step of pulling the distal ends of the pull straps.

23. The method as defined in claim 21, wherein each of the bladder anchors is connected to an inside loop of one of the loop units of the liner by one of a plurality of inside carabiners.

24. The method as defined in claim 23, wherein an outer loop of each of the loop units of the liner is connected to the proximal end of one of the pull straps through one of a plurality of outside carabiners.

* * * * *